US006254953B1

(12) United States Patent
Elston

(10) Patent No.: US 6,254,953 B1
(45) Date of Patent: Jul. 3, 2001

(54) ANTITHEFT HANG TAG FOLDED AND SECURED TO CONCEAL ANTITHEFT MARKER

(75) Inventor: Stephen Elston, Ormond Beach, FL (US)

(73) Assignee: World Color Printing Division, Inc., Ormond Beach, FL (US)

( * ) Notice: Subject to any disclaimer, the term of this patent is extended or adjusted under 35 U.S.C. 154(b) by 0 days.

(21) Appl. No.: 09/453,139

(22) Filed: Dec. 2, 1999

(51) Int. Cl.[7] ..... G08B 13/14

(52) U.S. Cl. ..... 428/40.1; 428/99; 428/124; 428/126; 428/137; 428/138; 428/916; 340/572.8; 340/572.1; 40/672

(58) Field of Search ..... 340/572.8, 572.9, 340/572.1; 40/672; 283/106, 81; 428/99, 137, 138, 40.1, 916, 126, 124

(56) References Cited

U.S. PATENT DOCUMENTS

| | | | |
|---|---|---|---|
| 3,711,848 | | 1/1973 | Martens . |
| 3,718,922 | | 2/1973 | Willaims et al. . |
| 4,342,904 | | 8/1982 | Onsager . |
| 4,694,283 | | 9/1987 | Reeb . |
| 5,285,191 | | 2/1994 | Reeb . |
| 5,291,180 | | 3/1994 | Reeb . |
| 5,517,177 | | 5/1996 | Cantrall . |
| 5,570,081 | | 10/1996 | Holstrom . |
| 5,583,489 | * | 12/1996 | Loemker et al. ..... 340/572.1 |
| 5,629,677 | | 5/1997 | Staino, Jr. . |
| 5,631,631 | | 5/1997 | Deschenes . |
| 5,635,917 | * | 6/1997 | Todman ..... 340/572.1 |
| 5,790,029 | | 8/1998 | Curnutte et al. . |
| 5,867,102 | | 2/1999 | Souder et al. . |
| 5,896,087 | | 4/1999 | Forwein . |
| 5,955,949 | | 9/1999 | Cocita . |
| 5,973,600 | | 10/1999 | Mosher, Jr. . |
| 5,982,282 | | 11/1999 | Ryan, Jr. . |
| 5,982,284 | | 11/1999 | Baldwin et al. . |
| 5,990,791 | | 11/1999 | Andreasen et al. . |

* cited by examiner

*Primary Examiner*—Alexander S. Thomas
(74) *Attorney, Agent, or Firm*—Hopgood, Calimafde, Judlowe & Mondolino

(57) ABSTRACT

A hang tag having an electronic article surveillance (EAS) device is provided by using a conventional hang tag substrate, such as paper, securing the EAS device therein, and folding the substrate onto itself and securing it with a permanent adhesive. Preferably the substrate is accordian folded. With the EAS device permanently secured and hidden in a fold, the article is more amenable to consideration by the consumer, and the EAS device is unobtrusive.

10 Claims, 1 Drawing Sheet

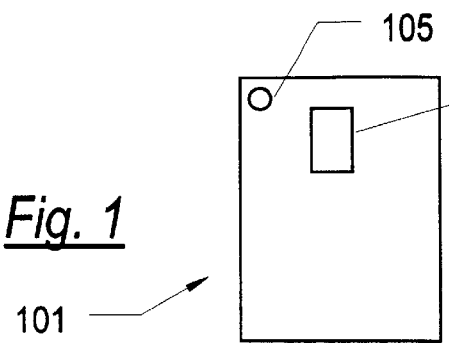
Fig. 1
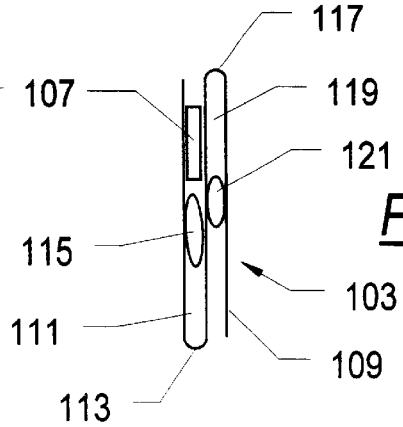
Fig. 2
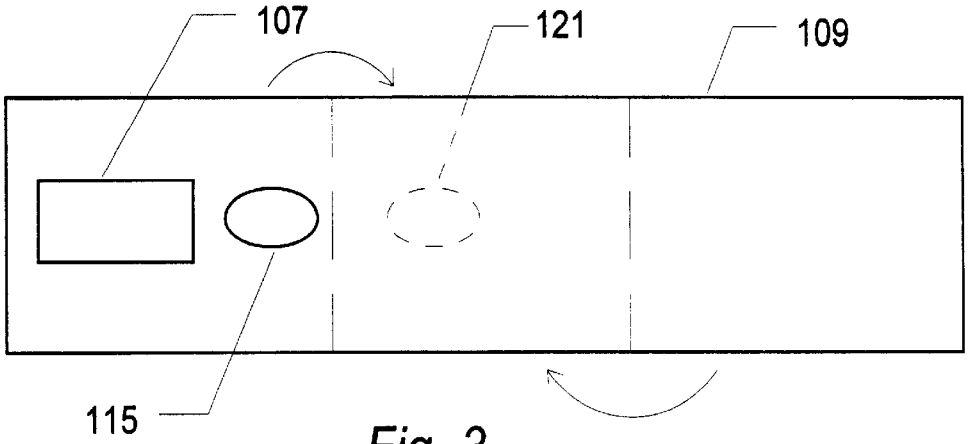
Fig. 3
Fig. 4
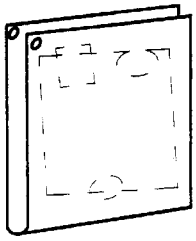
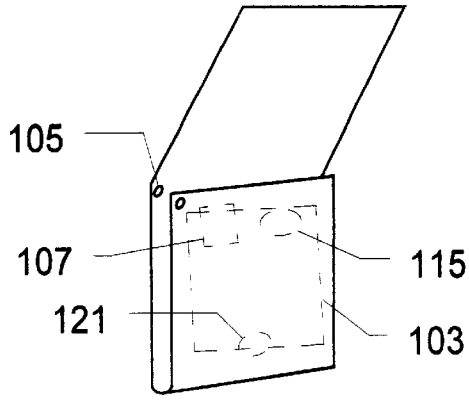
Fig. 5

ANTITHEFT HANG TAG FOLDED AND SECURED TO CONCEAL ANTITHEFT MARKER

BACKGROUND OF THE INVENTION

1. Field of the Invention

This invention relates to a novel hang tag having an antitheft remote sensor type device therein, and to production of such tags.

2. The State of the Art

Antitheft tags for consumer articles are well-known, and systems using such device are referred to as electronic article surveillance (EAS) systems. Exemplary of EAS devices and systems using the same are U.S. Pat. Nos. 5,949,336 and 5,955,951, and the references cited there. In one embodiment, EAS tags have a circuit having a known resonant frequency and inducable to resonate by an externally applied magnetic or RF field, the existence of the expected resonance being evidence of the article; hence, placing such a device at the exit of an establishment indicates that an article of merchandise with such a tag is being taken from the store.

EAS devices and systems are well-known and do not form part of this invention. Rather, one aspect that retailers and manufacturers find is important is to keep the EAS tag as small and unobtrusive as possible. For example, a consumer looking at an article of clothing is less likely to purchase the article if it cannot be tried on because of the EAS tag, or because the article is fairly light (such as a shirt) but the EAS tag is oversized and too heavy to allow the clothing article to be tried on. As another example, attaching a conventional EAS tag to sunglasses, depending where on the spectacle frame the EAS tag is attached, typically renders the glasses almost impossible to wear, and thus a consumer is less likely to make the purchase because the article cannot be assessed properly or easily. Thus, for example, the above-noted U.S. Pat. No. 5,955,951 describes a relatively large EAS tag that is secured with a tack through clothing, and the U.S. Pat. No. 5,949,336 patent describes a less obtrusive device but one which looks like plastic tag of some sort. Yet another problem is that potential shoplifters may attempt to remove from the merchandise an EAS tag, or any tag (including, for example, a price tag) that is easily identifiable as such.

SUMMARY AND OBJECTS OF THE INVENTION

In light of the foregoing, one object of this invention is to provide a method of associating an EAS device with an article in a manner that is unobtrusive.

Yet another object of this invention is to provide a hang tag having an EAS device.

In summary, in one embodiment this invention provides a hang tag having a folded substrate, an EAS disposed in the folded portion, and a permanent adhesive maintaining the fold. In a preferred embodiment, the hang tag substrate has a second fold removably secured with an adhesive.

Such devices can be made by a method comprising providing a hang tag substrate, attaching an EAS to the substrate, applying an adhesive the substrate near the EAS, folding the substrate back onto itself to hide the EAS in the fold and to seal the fold with the adhesive.

BRIEF DESCRIPTION OF THE FIGURES

FIG. 1 is an idealized front view of a hang tag according to this invention.

FIG. 2 is an idealized side view of a hang tag according to this invention.

FIG. 3 is an idealized top view of a substrate that can be folded into the hang tag shown in FIGS. 1 and 2.

FIG. 4 is a perspective view of the tag of FIG. 2 opened.

FIG. 5 is an alternative embodiment of the tag shown in perspective in FIG. 4.

DETAILED DESCRIPTION OF SPECIFIC EMBODIMENTS

As noted in the Background section, EAS devices are well-known and can be found described in such patents as U.S. Pat. No. 5,949,336 and U.S. Pat. No. 5,955,951, the disclosures of which are incorporated herein by reference in their entirety.

The present invention will be described herein with reference to a hang tag, although it will be appreciated that this invention can be used otherwise. A hang tag is typically used to mean a tag, typically a paper or cardboard substrate, attached to the article displayed to the consumer. Typically a hang tag is attached to the article by a nylon (or polyester, or other plastic, or cloth) string or loop. Hang tags are often seen in used with sales of clothing or smaller items such as sunglasses. While typically such clothing is displayed with a separate EAS, this invention incorporates the EAS directly and unobtrusively into the hang tag.

As shown in FIG. 1, a hang tag 101 typically has a face 103 on which a logo, trademark, or other advertising is printed. The string or loop holding the tag onto the article is typically passed through a hole 105 punched through the tag. The EAS 107 is disposed "inside" of the hang tag.

As shown in FIG. 2, a side view of the tag shown in FIG. 1, the preferred embodiment is a twice-folded substrate 109, essentially an accordian fold. The EAS is affixed to the substrate, preferably using a permanent adhesive, in a space 111 created by a first fold 111 in the substrate. To fix the first fold, a permanent adhesive is used to secure the portions of the substrate that define the fold. The remainder of the substrate is again folded 117 to provide a second space 119 in which additional advertising or promotional information can be printed or displayed. In such an embodiment, the second space is preferably removably secured using a pressure sensitive adhesive 121. In this way, a prospective purchaser can view the face of the tag and can open the second fold without destroying the tag to view the interior promotional information, and then resecure the fold because of the properties of the pressure sensitive.

FIG. 3 depicts the substrate prior to being folded. The substrate first has printed thereon the desired advertising or promotional materials, optionally including a bar code or another article identifier. The EAS is then attached to one portion of the substrate and a permanent adhesive is applied adjacent thereto. The dotted lines in FIG. 3 depict where the substrate is to be folded to achieve the configuration shown in FIG. 2; as shown by the arrows, the leftmost section is folded on top of the middle, and the rightmost section is folded under the middle section.

FIG. 4 shows the novel hang tag partially opened in perspective view. After the prospective purchaser views the face, the outer flap can be opened to reveal additional promotional and instructional information (outlined in the figure with dotted lines), the EAS being disposed in the other fold and secured with permanent adhesive. The outer flap is secured with the pressure sensitive adhesive; although this adhesive may reside over some of the printed material, because small amounts are used, and because the adhesive is essentially transparent (or slightly translucent), the printed material thereunder can still be viewed and read by the prospective purchaser. When the goods are sunglasses, which are relatively easy to shoplift (based on their size), the present invention allows the consumer to try on the glasses and read the promotional material, and yet the glasses are protected from theft by the hidden EAS.

FIG. 5 depicts another embodiment in which the top flap is absent, yet the EAS device is still unobtrusively hidden in the fold.

The substrate is preferably paper, paperboard, cardboard, or the like, but can also be made of any flexible sheet-like material, including leather, fabric, or plastic.

As mentioned above, these novel tags are preferably made by loading the substrate onto a conveyor, the EAS device is installed, an adhesive is applied and part of the substrate is folded over to seal the EAS device, a removable (e.g., pressure sensitive) adhesive is applied, and the final fold is made. If necessary, the tag is stored until the adhesives have cured. Machines for performing such fabrication are available from Jagenberg, Inc. (Enfield, Connecticut; e.g., a "folder gluer").

The foregoing description is meant to be illustrative and not limiting. Various changes, modifications, and additions may become apparent to the skilled artisan upon a perusal of this specification, and such are meant to be within the scope and spirit of the invention as defined by the claims.

What is claimed is:

1. A hang tag, comprising: a substrate folded upon itself twice in accordion fashion to provide two folds; an electronic article surveillance (EAS) device disposed in a first fold; and said first fold secured with a permanent adhesive.

2. The hang tag of claim 1, wherein a second of said two folds is removably secured with an adhesive.

3. The hang tag of claim 2, further comprising a hole punched therethrough.

4. The hang tag of claim 1, wherein the substrate is paper or paperboard.

5. A method for making a hang tag having an embedded EAS device therein, comprising: providing a substrate; providing an EAS device; permanently securing the EAS device to the substrate; applying a permanent adhesive to the substrate: folding the substrate onto itself to provide a first fold in which the EAS device is permanently secured; applying a second adhesive to the substrate; folding the substrate onto itself again to provide a second fold, said substrate being folded in accordian fashion and the second fold being secured with the second adhesive.

6. The method of claim 5, wherein the second adhesive is a pressure sensitive adhesive.

7. The method of claim 5, wherein the substrate is paper or paperboard.

8. A hang tag, consisting essentially of: a substrate folded upon itself; an electronic article surveillance (EAS) device disposed in the fold; and the fold secured with a permanent adhesive; and the substrate comprising paper or cardboard.

9. The hang tag of claim 8, further comprising a hole punched therethrough.

10. The hang tag of claim 8, wherein said hang tag consists of: a substrate folded upon itself; an electronic article surveillance (EAS) device disposed in the fold; the fold secured with a permanent adhesive; and a hole punched therethrough.

* * * * *